US007207797B2

(12) United States Patent
Perry et al.

(10) Patent No.: US 7,207,797 B2
(45) Date of Patent: Apr. 24, 2007

(54) OVEN FOR THE TREATMENT OF CONTAMINATED MATERIALS

(76) Inventors: Ophneil Henry Perry, 11 Blencartha Close, Gamston, Nottingham (GB) NG2 6RL; Rifat Alchalabi, 93 Chetwood Ter., Fanwood, NJ (US) 07023

( * ) Notice: Subject to any disclaimer, the term of this patent is extended or adjusted under 35 U.S.C. 154(b) by 12 days.

(21) Appl. No.: 10/540,610

(22) PCT Filed: Dec. 18, 2003

(86) PCT No.: PCT/GB03/05525

§ 371 (c)(1),
(2), (4) Date: Jun. 23, 2005

(87) PCT Pub. No.: WO2004/059229

PCT Pub. Date: Jul. 15, 2004

(65) Prior Publication Data

US 2006/0099543 A1 May 11, 2006

(30) Foreign Application Priority Data

Dec. 24, 2002 (GB) ..... 0230082.0

(51) Int. Cl.
*F27B 9/16* (2006.01)

(52) U.S. Cl. ..... 432/124; 432/141

(58) Field of Classification Search ..... 432/107, 432/206, 112, 117, 124, 141, 195; 110/214–242, 110/101 R; 34/130–132, 164, 168, 169
See application file for complete search history.

(56) References Cited

U.S. PATENT DOCUMENTS 2,805,493 A 9/1957 Bestehorn
2,952,921 A 9/1960 Wood et al.
3,619,908 A * 11/1971 Kallas ..... 34/573
3,824,703 A 7/1974 Moyne ..... 34/130
4,776,265 A * 10/1988 Ojima ..... 99/348
4,941,822 A * 7/1990 Evans et al. ..... 432/112

FOREIGN PATENT DOCUMENTS

| | | |
|---|---|---|
| DE | 1922985 | 2/1970 |
| FR | 880701 | 4/1943 |
| WO | WO 01/98092 | 12/2001 |

* cited by examiner

*Primary Examiner*—Gregory Wilson
(74) *Attorney, Agent, or Firm*—Young Basile

(57) ABSTRACT

An oven (10) has a rotatable portion (12, 14) comprising an outer chamber (20) and an inner treatment chamber (22) within the outer chamber. The inner treatment chamber is adapted to receive material for treatment and the oven has means (28, 32, 34, 36, 38, 42) to heat the inner treatment chamber externally. Preferably, the inner treatment chamber is heated by means of a flow of hot gases through the outer chamber, which passes over the external surfaces of the walls of the inner treatment chamber. The oven may also include means (44, 48) for introducing a flow of hot gasses through the inner treatment chamber. The flow rate of the hot gasses passing through the inner and outer chambers can be varied according to the nature of the material being treated. The oven is particularly suited to thermally de-coating scrap materials.

14 Claims, 6 Drawing Sheets

OVEN FOR THE TREATMENT OF CONTAMINATED MATERIALS

BACKGROUND OF THE INVENTION

The present invention relates to an oven. In particular the present invention relates to a development of the type of oven described in the applicants International patent application published as WO 01/98092 A1, the content of which is hereby incorporated by reference in its entirety.

There is an increasing requirement to recycle materials such as aluminium, magnesium and other metals and non-metals. Often such materials will be coated in paint, oil, water, lacquers, plastics, or other volatile organic compounds (V.O.C.s) which must be removed prior to re-melting the materials. For materials which are capable of being processed at relatively high temperatures without melting, such impurities are typically removed using a thermal process which is sometimes known as de-coating. Such thermal de-coating processes can also be used to dry and/or sterilize materials prior to remelting.

For example, aluminium is often used in the production of beverage cans which are typically coated in paint, lacquers and/or other V.O.C.s. Before used beverage cans (U.B.C.s) or scrap material produced during the manufacture of beverage cans can be melted down for recycling, any coatings or other impurities must be removed in order to minimize metal loss.

Thermal de-coating, however, is not limited to application to aluminium but can be used to clean or purify any metal or non-metallic materials which are capable of withstanding the temperatures present in the thermal de-coating process. Thermal de-coating can be used to de-coat or purify magnesium or magnesium alloys for example.

Known thermal de-coating processes involve exposing the material to be treated to hot gases in order to oxidise the coatings and/or impurities which are to be removed. This exposure takes place in a closed and controlled environment in which the temperature and oxygen content of the hot gases can be controlled during the de-coating process. Temperatures in excess of 300 C are required to remove most organic compounds and an oxygen level in the range of 6% to 12% is normally required.

If the temperature and oxygen levels of the hot gases are not carefully controlled this can lead to oxidation of the metal as the V.O.C.s which are released during the thermal stripping are combusted. This can result in an uncontrolled increase in the temperature of the hot gases which leads to further metal loses and can be very dangerous.

The material will usually be shredded before treatment and it is important for effective de-coating that all the surfaces of the shredded material are exposed to the hot gases. If this does not occur then the treatment becomes less effective and, in the case of U.B.C.s in particular, a black stain may be left on the surface of the treated material. It is also desirable for the material to be agitated during the treatment to physically remove lose coatings or impurities from the material.

At present there are three main systems which are used on an industrial scale for thermal de-coating, these are:

1. Static Oven

In a static oven, the material is stacked on a wire mesh and hot gases are recirculated through the oven to heat the material to the required process temperature.

This arrangement is not efficient because the hot gases do not come in to contact with the materials that are enclosed within the stack of materials on the mesh. As discussed previously, it is important in de-coating that all the surfaces of the materials being treated are exposed to the hot gases. Also there is no agitation of the material being treated.

2. Conveying Oven

This system uses a mesh belt conveyor to transport materials for treatment through an oven. Hot gasses are passed through the material on the belt as it passes through the oven. The problems with this method are as follows:

- The depth of materials on the belt limits the process. The materials are stacked, causing similar problems to those found with the static oven in which materials at the centre of the stack do not come into contact with the hot gases
- There is no agitation of the materials, so loose coatings are not removed.
- The conveyor belt life is short.
- The materials have to be constantly fed.
- The process is not suitable for low volume or continuously changing product.

3. Rotating Kiln

A large kiln is inclined to the horizontal so that material fed or charged into the kiln at its highest end travels towards the lowest end, where it is discharged, under the influence of gravity. The kiln is rotated so that material within the kiln is agitated and a flow of hot gases is provided to heat up the material as it travels through the kiln. A number of problems are associated with this method:

- The material has to be constantly fed.
- The process is not suitable for low volume or continuously changing product.
- The continuous process requires air locks at both ends, materials charge end and materials discharge end.
- The kiln requires a rotating seal leading to a high level of maintenance.

WO 01/98092 A1 describes a pivotable or tiltable oven that overcomes many of the disadvantages of the previously known apparatus and methods for thermal de-coating. For a detailed description of the construction and operation of the oven, the reader should refer to WO 01/98092 A1. However, briefly, the oven has a charging portion for receiving material to be treated and a changeover portion. Incorporated within the changeover portion is a heat treatment chamber through which a stream or flow of hot gasses can be passed. The oven is pivotally moveable between a first position in which the changeover portion is higher than the charging portion and a second position in which the charging portion is higher than the changeover portion. The arrangement is such that the oven can be repeatedly moved between the first and second positions so that material within the oven falls from one portion to the other portion, passing through the stream of hot gasses in the heat treatment chamber. A method of using the apparatus is also disclosed.

The above known oven has the advantage that it can be used to treat comparatively low volumes of material in a batch process. A further advantage is that by controlling the movement of the oven, the material being treated can be brought into and out of the heat treatment chamber at will, enabling the oven to be operated safely without the process going autothermic in an uncontrolled manner and allowing a very fine degree of control of the treatment process.

The oven described in WO 01/98092 A1 has been found to work well, providing a commercially and technically acceptable means of thermally de-coating relatively low volumes of materials. However, when treating light weight materials, such as powders or materials that have been shredded into very small pieces, there can be a tendency for some of the material being treated to become entrained in the flow of hot gasses passing through the heat treatment chamber. Whilst some of the entrained material can be filtered out of the gas flow and recollected, there is an overall reduction in the efficiency of the process.

It is an object of the present invention is to provide an improved oven in which the problems of the known oven are overcome or at least reduced.

SUMMARY OF THE INVENTION

In accordance with the invention, there is provided an oven comprising;

a charging portion for receiving material to be treated;

a rotatable changeover portion comprising an outer chamber and an inner treatment chamber within the outer chamber;

and means to heat the inner treatment chamber externally thereof;

the oven being moveable between a first position in which the changeover portion is generally higher than the charging portion and a second position in which the charging portion is generally higher than the changeover portion;

the inner treatment chamber being adapted to receive material from the charging portion as the oven moves from the first position to the second position.

It is an advantage of an oven in accordance with the invention, that the material treated in the inner treatment chamber can be heated indirectly by virtue of the external heating of the inner treatment chamber. A further advantage of an oven in accordance with the invention is that the walls of the inner treatment chamber are heated by the external heating means. When the material being treated enters the inner treatment chamber, some will come into contact with the hot walls, helping to heat the material and so reducing processing times.

In a preferred embodiment, the external heating means comprises a flow of hot gasses through the outer treatment chamber and which passes over at least part of the external surface of the inner treatment chamber.

It is a particular advantage of the invention that the material being treated is separated from the flow of gasses through the outer chamber by the inner treatment chamber. As a result, the material does not become entrained in the flow of gasses through the outer chamber.

In a particularly preferred embodiment the oven further comprises an inlet means for introducing a flow of hot gases into the inner treatment chamber and outlet means through which the flow of hot gasses can exit the inner treatment chamber.

In an oven in accordance with the preferred embodiment a flow or stream of hot gases can be generated through the inner treatment chamber. Material entering the inner treatment chamber will be introduced into the flow of hot gases in the inner treatment chamber to be heated in much the same way as with the prior art oven described in WO 01/98092 A1. However, because the inner treatment chamber can also be heated externally, the flow of hot gasses through the inner treatment chamber can be reduced when treating lightweight materials, so reducing the likelihood of the material becoming entrained. When treating heavier materials, the flow of hot gases through the inner treatment chamber can be increased to ensure effective treatment. The balance of the flow of hot gases through the inner treatment chamber and the external heating of the chamber can be adjusted to suit any particular material to the treated.

Preferably, the means for introducing a flow of hot gases comprises an array of inlet nozzles.

Advantageously, the array of nozzles are located adjacent a first side wall of the inner treatment chamber.

Preferably, the means for introducing a flow of hot gases through the inner treatment chamber further comprises an outlet vent through which the gasses can exit the inner treatment chamber. The outlet vent may be located in a second side wall of the inner treatment chamber opposite from the first wall. Preferably, the outlet vent is positioned such that, in use, as the oven moves between the first and second positions, the material passing between the charging box and the inner treatment chamber does not fall through the outlet vent.

Preferably, the oven is rotated in a first direction as it moves from the first position to the second position and is rotated in the opposite direction as it moves from the second position to the first position.

Preferably, the oven further comprises a control means for regulating the flow and/or the oxygen content of gasses passing through the outer treatment chamber. In which case, the control means may also adapted to regulate the flow and/or oxygen level of the gasses flowing through the inner treatment chamber independently of the gases flowing through the outer treatment chamber.

BRIEF DESCRIPTION OF THE DRAWINGS

An embodiment of the invention will now be described, by way of example only, with reference to the following drawings in which.

DETAILED DESCRIPTION OF THE PREFERRED EMBODIMENT

Figure 1:
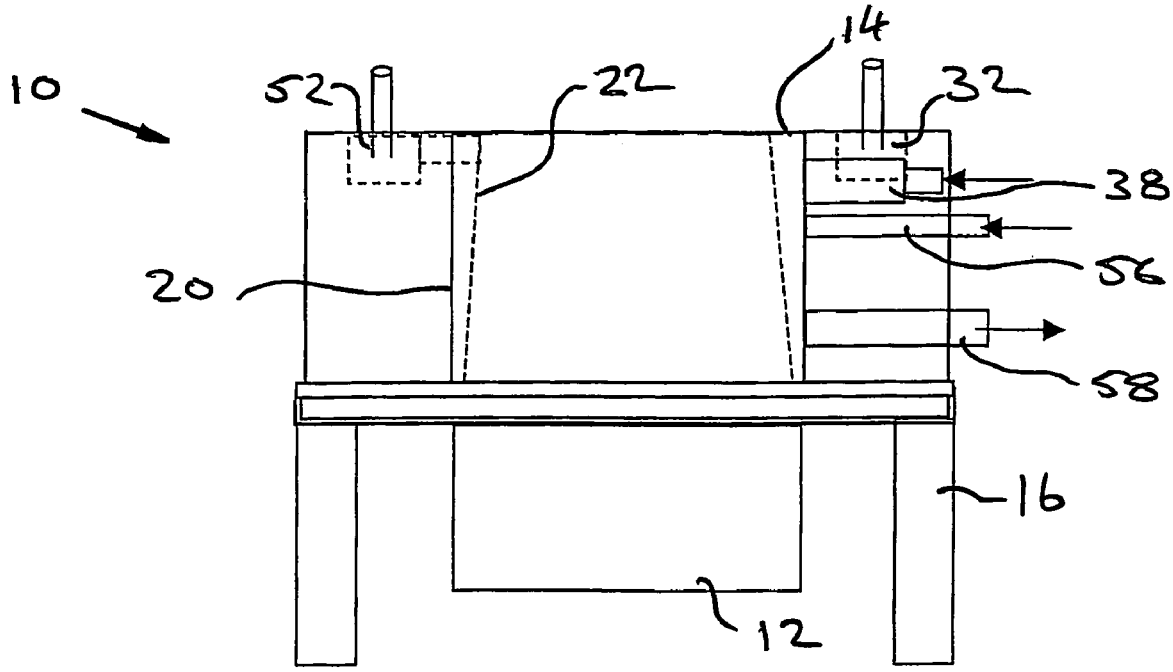
FIG. 1 is a front elevation of an oven in accordance with the invention.
Figure 2:
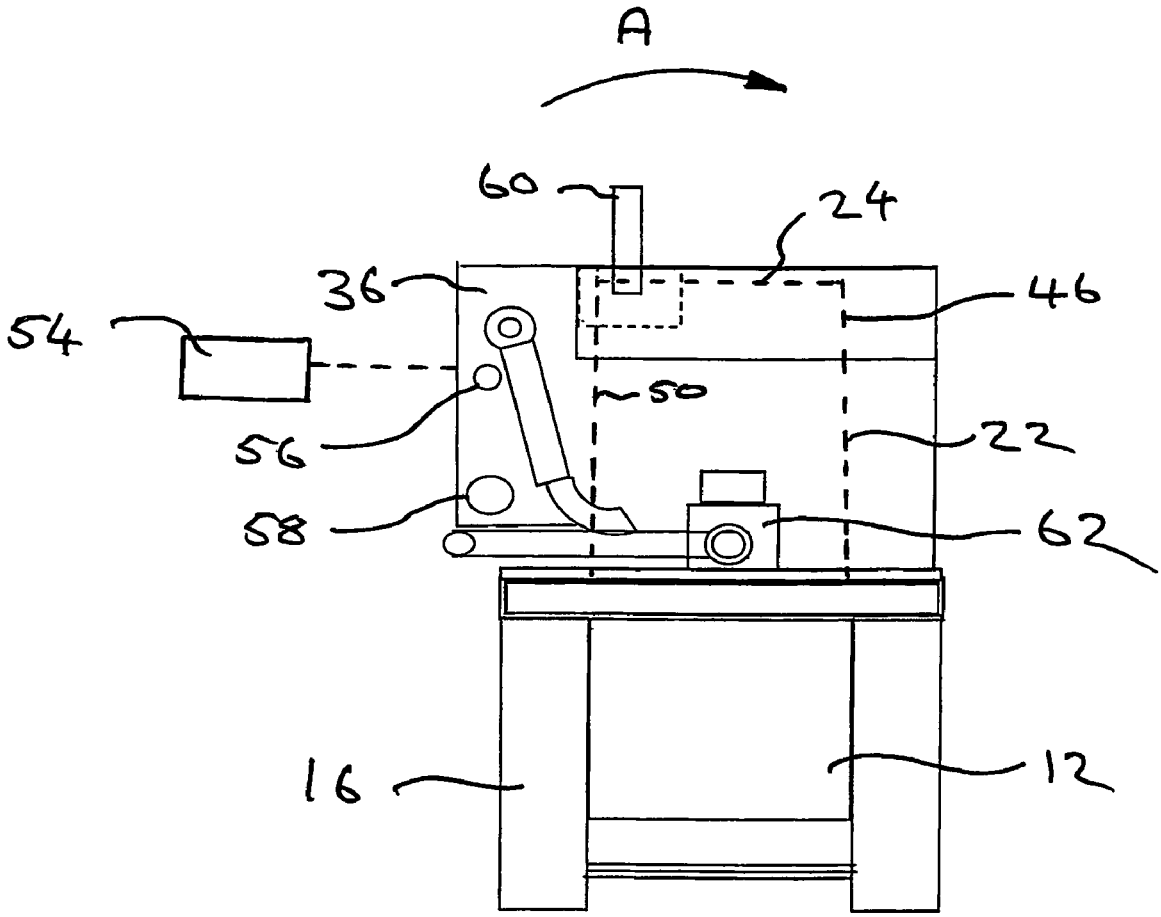
FIG. 2 is an end elevation of the oven of FIG. 1, shown in a first position.
Figure 3:
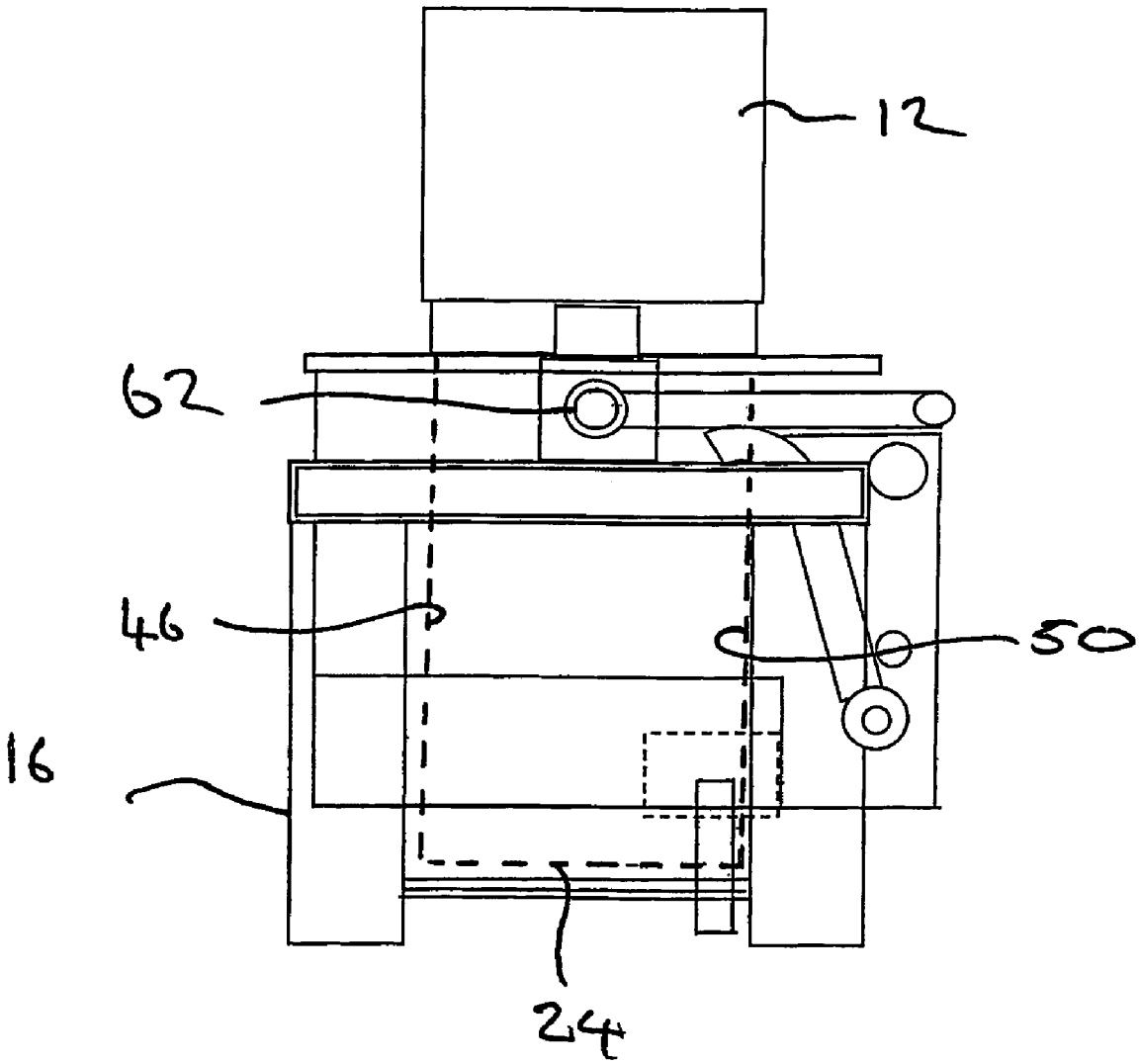
FIG. 3 is a view similar to that of FIG. 2 but showing the oven in a second, inverted position.

An oven 10 comprises a charging portion 12 and a changeover portion 14. The oven is mounted to a support 16 so as to be movable between a first position in which the changeover portion is generally higher than the charging portion (as shown in FIG. 2), and a second position in which the charging portion is generally higher than the changeover portion (as shown in FIG. 3).

The charging portion 12 is in the form of a charging box which is removably mountable to the changeover portion 14. The charging box 12 is substantially rectangular in shape. The end of the box which is uppermost when the oven is in the first position has an opening 18 through which material can enter and exit the box 12.

The changeover portion 14 has an outer treatment chamber 20 and an inner treatment chamber 22 located within the outer treatment chamber. The inner treatment chamber is generally rectangular in shape though tapering inwardly towards a base 24. The inner treatment chamber 22 has an opening 26 in a face opposite to the base 24, which face is lowermost when the oven is in the first position. The opening 26 of the inner treatment chamber is substantially the same size as the opening 18 of the charging box 12. When the charging box 12 is mounted to the changeover portion 14, the openings 18, 26 of the charging box and the inner treatment chamber are aligned face to face so that material can pass between the charging box 12 and the inner treatment chamber 22 as the oven is moved between the first and second positions.

Figure 4:
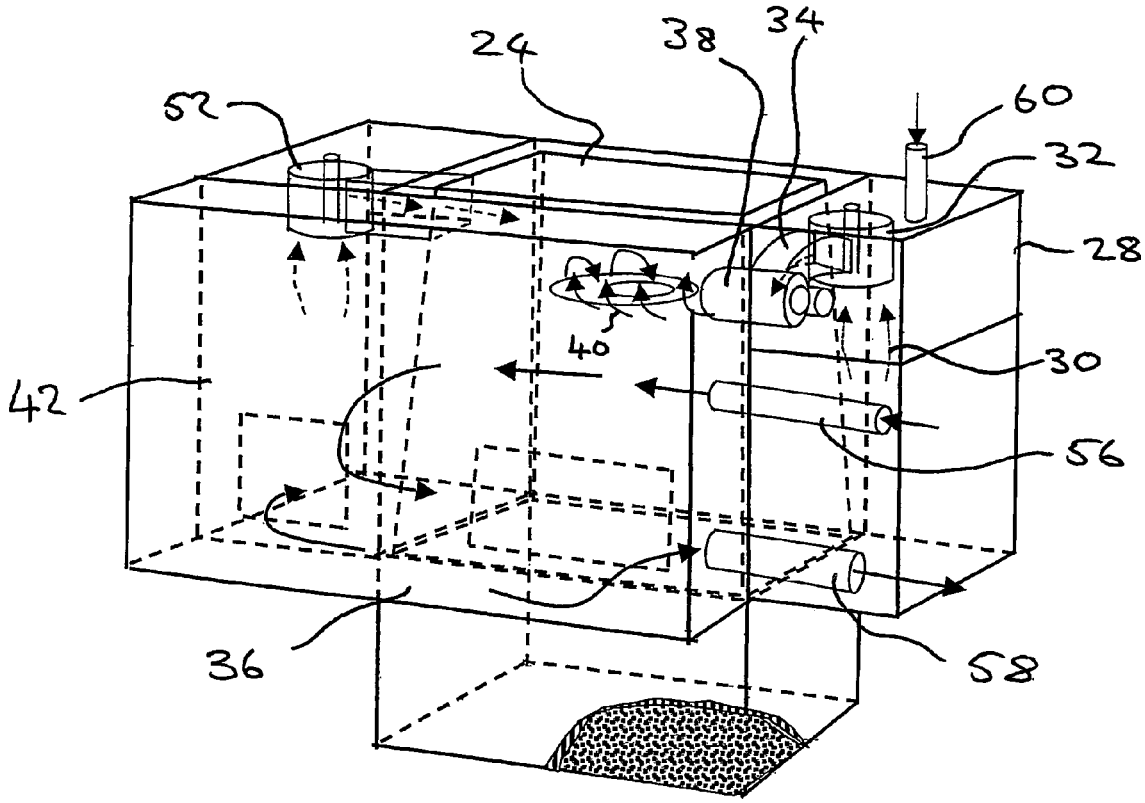
FIG. 4 is a perspective view of the oven of FIG. 1, showing various features in hidden detail.

The oven has means for recirculating a flow of hot gases, which may be a mixture of air and volatiles, through the inner and outer treatment chambers 22, 20 in a manner similar to that described in WO 01/98092 A1, to which the reader should refer for a detailed description. To this end, as can be seen from FIG. 4 in particular, on one side of the oven there is a recirculation chamber 28 into which the recirculated gases 30 are drawn from the outer treatment chamber 20 by a recirculating fan 32. An air mixing jacket 34 guides the gases from the recirculation chamber 28 into an afterburner chamber 36 in which the gasses are heated by a burner 38. The walls of the afterburner chamber 36 can be air cooled stainless steel walls or may be lined with a suitable refractory material.

The burner 38 which heats the gasses may be designed to run on either a gaseous or a liquid fuel or both. In a preferred embodiment the burner is also designed so as to be able to burn the V.O.C.s which are thermally stripped from the materials in the inner treatment chamber 22. These V.O.C.s are drawn out of the inner treatment chamber 22 and the outer treatment chamber 20 with the gases 30 by the recirculating fan 32 and are mixed with the gases in the mixing jacket 34. The air mixing jacket 34 is designed to ensure that the gasses enter the afterburner with a helical flow, as indicated by the arrows 40, which ensures that V.O.C.s have a maximum residence time and exposure to the hot zone of the burner flame.

By burning the V.O.C.s the overall thermal efficiency of the oven is increased since less fuel need be supplied to heat the gases 30 to the required operating temperature. If sufficient V.O.C.s are present, no additional fuel need be added to heat the gases to the required temperature so that the process can operate autothermically but in a controlled manner.

Burning the V.O.C.s also improves the control of emissions by removing these pollutants from the re-circulating gases and reducing the need for further and expensive treatment of gases which are exhausted from the afterburner chamber as is described in WO 01/98092 A1.

From the afterburner chamber 36, the hot gases enter a pre-treatment chamber 42 from where they are feed into the outer treatment chamber 20 on the opposite side of the oven from the recirculation chamber 28. As the gases pass through the outer treatment chamber from the pre-treatment chamber 42 to the recirculation chamber 28, they flow around most of the outer surfaces of the walls of inner treatment chamber. The walls of the inner treatment chamber are made of a suitable material, such as stainless steel, and are heated by the hot gases passing over them. A certain amount of this heat is also conducted through the walls into the air within the inner treatment chamber.

Figure 5:
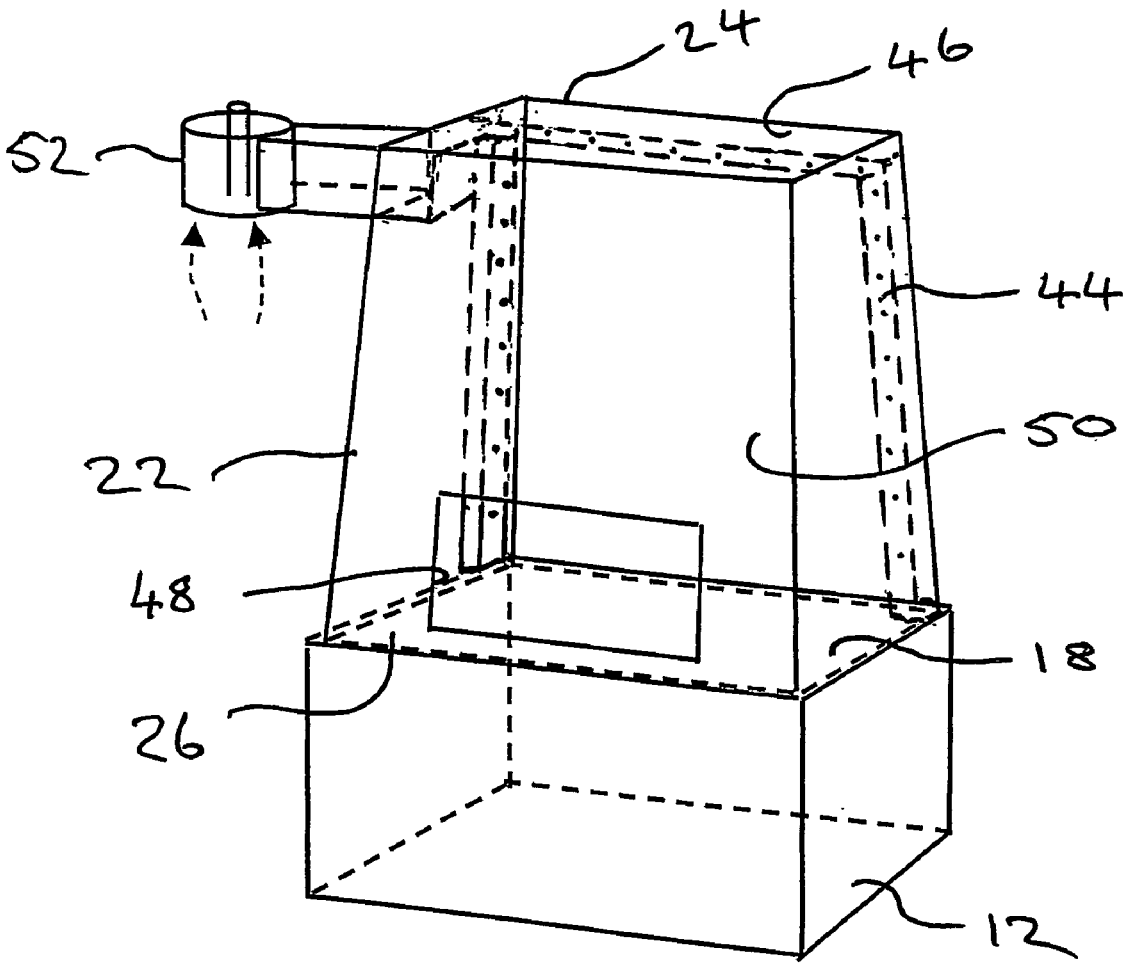
FIG. 5 is a perspective view of an inner treatment chamber forming part of the oven of FIGS. 1 to 4, shown connected to a charging box of the oven.

In order to provide a flow of hot gases through the inner treatment chamber 22, the inner treatment chamber 22 is provided with an array of gas inlet nozzles 44 (indicated schematically in FIG. 5). The nozzles may be located adjacent to a first side wall 46 of the inner treatment chamber 22. An opening or outlet vent 48 is provided in a second side wall 50 of the inner treatment chamber opposite from the first. A further recirculating fan 52 draws gases from the pre-treatment chamber 42 and supplies the gases to the nozzles 44 from where they flow across the inner treatment chamber 22 and are drawn out through the outlet vent 48. The gases exiting the outlet vent join with the gasses flowing through the outer treatment chamber 20 and are drawn into the recirculating chamber 28 by the first recirculating fan 32. If required, more than one recirculating fan 52 can be provided.

A further set of inlet nozzles (not shown) can be provided between the first and second side walls 46, 50 of the inner chamber if required.

A control system (indicated schematically at 54 in FIG. 2) monitors and controls the level of oxygen and the temperature of the gases individually in both the outer treatment chamber 20 and the inner treatment chamber 22 to ensure the system operates within safe and effective limits for thermal de-coating of the material being treated. Typically, the oxygen level will be maintained below 16% whilst temperatures in excess of 300 C are required to remove most organic compounds. A lance 56, regulated by the control system, supplies fresh air into the afterburner chamber 36 so as to control both the required level of oxygen and temperature of the gases. The afterburner chamber 36 exhausts combustion gases through an exhaust pipe 58. The flow of exhaust gases being controlled via temperature and pressure controlled damper (not shown).

An auxiliary fresh air inlet 60 is also provided in the recirculation chamber 28. The auxiliary inlet 60 allows air to enter the recirculation chamber to mix with the hot gases and to cool the fan 32. The control system monitors the temperature of the fan and operates a valve to control the flow of air through the auxiliary inlet to maintain the temperature of the fan below its maximum permitted operating temperature. The control system balances the flow of air through the lance 56 and the auxiliary inlet 60 in order to maintain the required oxygen content and temperature of the gases in the inner 22 and outer 20 treatment chambers.

The oven 10 is pivotably mounted to the support structure 16. Means 62 are provided for automatically moving the oven between the first and second positions under the control of the control system 54 for the oven. This means can be of any suitable form and may, for example, comprise one or more electric or hydraulic motors. The motors may act through a gearbox if required. Alternatively the means may comprise one or more hydraulic or pneumatic rams. The means could also comprise a combination of motors and rams.

The oven is arranged to rotate in the direction indicated by arrow A in FIG. 2 when moving from the first position to the second position. When the oven 10 reaches the second position, rotation is stopped. To move the oven 10 from the second position to the first position, the oven is rotated in the opposite direction.

As the oven 10 moves from the first position towards the second position, the first side wall 46 of the inner treatment chamber 22 remains below the opposing second side wall 50 in which the outlet vent 48 is provided. Similarly when the oven moves in the reverse direction from the second position to the first position, the wall 46 of the inner treatment chamber will again remain below the opposing wall 50 in which the outlet vent 48 is provided. As the oven is moved from the first position to the second position, the material being treated will tend to fall from the charging box 12 onto the first side wall 46 of the inner treatment chamber and then downwards on to the base 24 of the inner treatment chamber. Similarly when the oven is moved in the reverse direction from the second position to the first position the material will tend to fall from the base 24 of the inner treatment chamber onto the first side wall 46 and then back into the charging box 12. By positioning the outlet vent 48 in the wall 50 opposite to the wall 46 which remains lowermost during the rotary movement of the oven, it can be ensured that none of the material will fall through the outlet vent as the oven moves between the first and second positions.

In an alternative embodiment, rather than the oven being rotated reciprocally between the first and second positions, the oven could be adapted so that it is rotated through 360 degrees in the same direction to move from the first position through the second position and back to the first position. In this alternative arrangement, the outlet vent 48 in the inner chamber can be provided with a suitably sized mesh to prevent the material being treated from passing through the vent. This arrangement would be most suited for use in treating materials having a relatively large size and which can be retained in the inner treatment chamber 22 by the mesh.

Operation of the oven will now be described.

The material to be processed is loaded into the charging box 12 which is then transported to the oven by means of a fork lift truck or other means. Once the charging box 12 is in position it is locked to the changeover portion. The treatment process can then be initiated under the control of the control system 54.

The gases passing through the inner 22 and outer 20 chambers of the changeover portion are heated. The oven is then rotated from the first position as shown in FIG. 2 until it reaches the second position shown in FIG. 3 in which the oven is inverted.

As the oven is rotated, the materials in the charging box 12 will fall under the influence of gravity into the inner treatment chamber 22. As they do so, the materials enter the stream of hot gases in the inner treatment chamber 22. Also, some of the material will come into direct contact with the wall 46 and base 24 of the inner treatment chamber 22 which will be at an elevated temperature. This heat will be conducted in to the material to assist in the heat treatment.

The rotary movement of the oven can then be reversed, until the oven is returned to the first position. During this reverse rotary movement, the materials will fall from the inner treatment chamber 22 back into the charging box 12. The reciprocal rotary movement of the oven between the first and second positions is repeated a number of times as required by the process control until the material is fully treated.

As the oven is repeatedly moved between the first and second positions, the materials being treated are mixed so that at some point most of the material will have come into contact with the heated walls and base 24 of the inner treatment chamber 22. This helps to speed up the treatment process by increasing the temperature of the materials.

The treatment process goes through a number of phases or cycles: a heating cycle during which the hot gases and the materials are brought up to the required treatment temperature, a treatment cycle in which the temperature of the gasses and materials is maintained at the treatment temperature, and finally a cooling cycle during which the temperature of the gases and the treated material is brought down to a level at which the material can be safely removed.

Once the treatment process is completed, the oven is returned to the first position and the charging box 12 removed so that the treated material can be transported for cooling, storage or further processing as required.

The rotary motion of the oven ensures that the material to be treated passes through the stream of gases in the inner treatment chamber 22 in a controlled manner. The falling action of the material also ensures that all the surfaces of the material become filly exposed to the gases in the inner chamber 22 promoting an efficient and effective de-coating and/or decontamination.

The control system controls the speed and frequency of the rotary movement of the oven along with the temperature and oxygen level of the gases in the inner and outer treatment chambers 20, 22 in order to oxidize coatings or impurities on the material whilst ensuring the process is carried out safely and efficiently with minimum loss of the material being treated.

Any V.O.C.s or other volatiles given off during the treatment of the material are removed from the inner treatment chamber 22 with the gasses as they flow out of the outlet 48 and rejoin the gases 30 flowing through the outer treatment chamber to be recirculated through the afterburner chamber 36 where most of the V.O.C.s are incinerated.

When a light-weight material is to be treated, the flow of gases through the inner treatment chamber 22 can be reduced to the minimum necessary to remove the volatiles thermally without entraining the material in the gas flow. To ensure the material is brought to a high enough temperature to be successfully de-coated or otherwise treated, the flow of gases through the outer treatment chamber 20 around the inner treatment chamber 22 can be increased and/or the temperature of those gases increased.

When the material to be treated is relatively heavy, the flow of gases through the inner treatment chamber 22 can be increased and the flow of gases through the outer treatment chamber 20 decreased to the point where most of the heating of the material is effected by the gasses flowing through the inner treatment chamber and directly impinging on the heavy coated material.

The control means can be set to regulate the flow and temperature of the gases through the inner and outer treatment chambers independently as required for any particular material.

Figure 6:
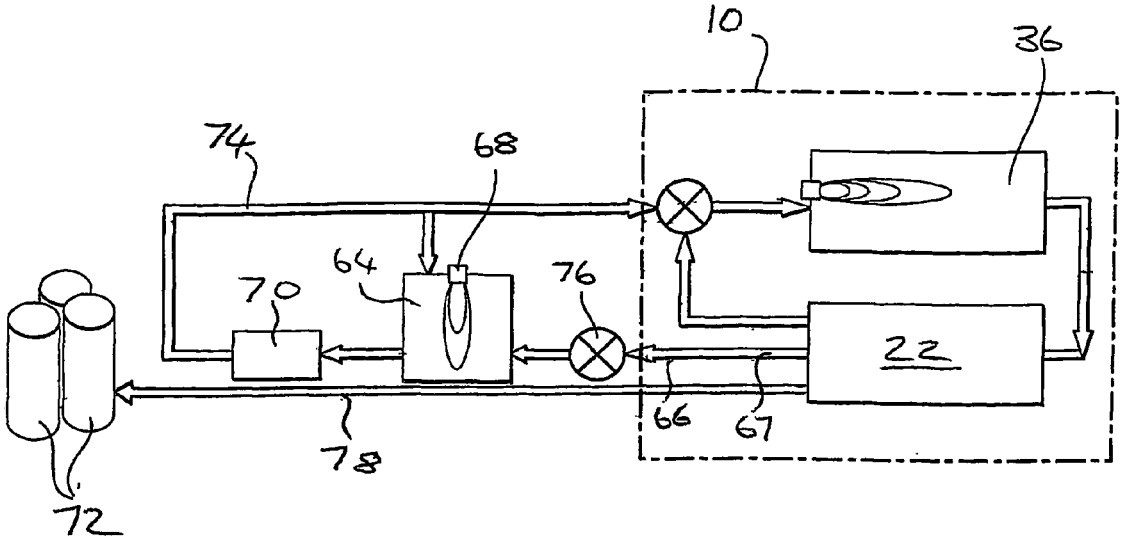
FIG. 6 is a schematic diagram showing an oven in accordance with the invention connected with a second afterburner and an air pollution control unit.

The oven may also be provided with a second afterburner and cooling system as shown schematically in FIG. 6, if required. The second afterburner system 64 can be located next to the rotating oven 10 and is connected via ducts 66, which may be stainless steel and/or insulated, that transfer some of the hot gases with the volatiles 67 from the inner treatment chamber 22 into the second afterburner 64.

Inside the second afterburner 64 the volatiles are incinerated with the aid of a second burner 68. The exhaust gasses from the second afterburner 64 are cooled in a separate cooling system 70 which may be located adjacent the second afterburner system 64. After passing through the cooling unit 70, the exhaust gasses, which now contain no fuel or oxygen and so are inert, can be recirculated back into the first afterburner chamber 36 and/or the second afterburner 64 via further ducts 74 in order to help reduce the combustion process further. The hot gasses are circulated through the second afterburner 64 and the cooling system 70 by a second recirculating fan 76. The cooling system 70 uses indirect cooling, for example a heat exchanger system, to provide a controlled cooling which yields a temperature level that is acceptable to the air pollution control unit 72.

A separate stream of exhaust gasses from the oven is taken via another series of ducts 78, which may be stainless steel and/or insulated, directly to an air pollution control unit 72 such as a bag or reverse jet filtration system. Preferably, the air pollution control unit comprises high temperature ceramic filters that are capable of receiving gasses having a temperature greater than 120 degrees Celsius and preferably gasses having a temperature above 300 degrees Celsius. This means that the gasses do not require dilution with air before entering the air pollution control unit and prevents reformation of dioxins. The gasses leaving the air pollution control unit into the atmosphere can be subject to rapid gas quenching in a known manner.

Where the second afterburner and cooling system are not required, they can simply be omitted, in which case all the exhaust gasses from the first afterburner chamber can be directed to the air pollution control unit 72.

Whereas the invention has been described in relation to what is presently considered to be the most practical and preferred embodiment, it is to be understood that the invention is not limited to the disclosed arrangements but rather is intended to cover various modifications and equivalent constructions included within the scope of the invention as defined by the claims. For example, whilst it is preferred that the external heating of the inner treatment chamber is effected by means of recirculating hot gasses through of the outer treatment chamber, this need not be the case and other suitable means of externally heating the inner chamber may be used. In one example, the inner chamber could be heated by means of external electrical heating elements. The oven in accordance with the invention could also be provided with means for separating the inner treatment chamber 22 from the charging portion 12 so that the material being treated can be retained in the inner chamber 22 or the charging box 12 as the oven is rotated. A suitable means for separating the inner treatment chamber 22 may be a series of flaps or dampers similar to those described with reference to FIG. 5 in WO 01/98092 A2 positioned to close the opening 26 of the inner treatment chamber or the opening 18 of the charging box to control movement of the material between the charging portion and the inner treatment chamber.

The invention claimed is:

1. An oven comprising:

a charging portion for receiving material to be treated;

a rotatable changeover portion comprising an outer chamber and an inner treatment chamber within the outer chamber;

means to heat the inner treatment chamber externally thereof; and an array of inlet nozzles located adjacent a first side wall of the inner treatment chamber for introducing a flow of hot gasses through the inner treatment chamber;

the oven being moveable between a first position in which the changeover portion is generally higher than the charging portion and a second portion in which the charging portion is generally higher than the changeover portion;

the inner treatment chamber being adapted to receive material from the charging portion as the oven moves from the first position to the second position.

2. An oven as claimed in claim 1, wherein means are provided for introducing a flow of hot gases through the outer treatment chamber so that, in use, the gases flow around at least part of the external surfaces of the inner treatment chamber to heat the inner treatment chamber externally.

3. An oven as claimed in claim 2 further comprising means for introducing a flow of hot gases through the inner treatment chamber, in which the oven further comprises a control means for regulating at least one of the flow and the oxygen content of gases passing through the outer treatment chamber.

4. An oven as claimed in claim 3 in which the control means is also adapted to regulate at least one of the flow and oxygen level of the gases flowing through the inner treatment chamber independently of the gases flowing through the outer treatment chamber.

5. An oven as claimed in claim 1 in which the means for introducing a flow of hot gases through the inner treatment chamber further comprises an outlet vent trough which the gases can exit the inner treatment chamber.

6. An oven as claimed in claim 5, in which the outlet vent is located in a second side wall of the inner treatment chamber opposite from the first wall.

7. An oven as claimed in claim 1, in which the outlet vent is positioned such that, in use, as the oven moves between the first and second positions, the material passing between the charging box and the inner treatment chamber does not fall trough the outlet vent.

8. An oven as claimed in claim 1, in which the oven is rotated in a first direction as it moves from the first position to the second position and is rotated in the opposite direction asit moves from the second position to the first position.

9. An oven as claimed in claim 1 wherein the oven is movable between first and second positions by at least one motor.

10. An oven as claimed in claim 1 wherein ihe oven is movable between first and second positions by at least one hydraulic motor and ram arrangement.

11. An oven as claimed in claim 10 wherein the ram arrangement includes a pneumatic ram.

12. An oven as claimed in claim 1 further comprising control means to regulate the operating conditions of the oven.

13. An oven as claimed in claim 12 wherein said control means regulates the flow of oxygen to the oven.

14. An oven as claimed in claim 12 wherein the control means controls the operating temperature of the oven.

* * * * *

UNITED STATES PATENT AND TRADEMARK OFFICE

CERTIFICATE OF CORRECTION

PATENT NO. : 7,207,797 B2
APPLICATION NO. : 10/540610
DATED : April 24, 2007
INVENTOR(S) : Ophneil Henry Perry et al.

It is certified that error appears in the above-identified patent and that said Letters Patent is hereby corrected as shown below:

Column 3, Line 14: Replace “comprising;” with --comprising:--.
Column 8, Line 7: Replace “filly” with --fully--.
Column 10, Line 23: Replace “trough” with --through--.
Column 10, Line 32: Replace “trough” with --through--.
Column 10, Line 36: Replace “asit” with --as it--.
Column 10, Line 40: Replace “ihe” with --the--.

Signed and Sealed this

Eighteenth Day of September, 2007

JON W. DUDAS
*Director of the United States Patent and Trademark Office*